United States Patent [19]

Watanabe

[11] Patent Number: 4,630,862

[45] Date of Patent: Dec. 23, 1986

[54] DENTAL CHAIR

[75] Inventor: Minoru Watanabe, Kyoto, Japan

[73] Assignee: Kabushiki Kaisha Morita Seisakusho, Kyoto, Japan

[21] Appl. No.: 678,661

[22] Filed: Dec. 6, 1984

[30] Foreign Application Priority Data

Dec. 10, 1983 [JP] Japan ..... 58-190749[U]

[51] Int. Cl.[4] ..... A47B 39/00

[52] U.S. Cl. ..... 297/167; 297/163; 297/191

[58] Field of Search ..... 297/167, 168, 169, 191, 297/163; 108/30

[56] References Cited

U.S. PATENT DOCUMENTS 3,588,172 6/1971 McGregor ..... 297/191 X 3,595,179 7/1971 Taylor ..... 108/30

3,813,147 5/1974 Rick ..... 297/191

4,141,586 2/1979 Goldner ..... 297/167 X

*Primary Examiner*—James T. McCall

*Attorney, Agent, or Firm*—Koda and Androlia

[57] ABSTRACT

A dental treatment chair including a seat, a backrest tiltably attached to the seat, and a drive means for tilting the backrest. The chair includes a unit table which stays horizontal and moves and up and down as the backrest tilts, and the table is further connected to the backrest by a longitudinal shaft and a support shaft so that it can freely rotate in a horizontal plane. By means of this structure, an operator can take a position convenient to access treatment tools and to take a position opposite to the unit table in response to each tilting phase of the backrest.

3 Claims, 4 Drawing Figures

DENTAL CHAIR

BACKGROUND OF THE INVENTION

1. Field of the Invention

This invention relates to a dental chair.

2. Prior Art

As is well know, it is necessary in dental treatment to movably arrange a dental chair and a unit table on which the treatment tools, medicines, and other various dental instruments are placed, corresponding to the patient's mouth and the dentist's operation position.

Included in such a unit table is a dental chair attached type table designed to be slidable longitudinally to the backrest of the chair and movable in a horizontal plane. Also included is an overarm type table held by a hanger arm from a pole set up along the side of the chair or from the wall surface.

The dental chair attached type table is limited in use to a horizontal dental chair, and it is apparent that the table does not fit structurally for use in a table whose backrest is tiltable. On the other hand, the overarm type table is also adjustable vertically, but the table is still not satisfactory in that it gives a sense of discomfort to the patient because the hanger arm is positioned above the patient lying on his side an also because the hanger arm of the unit can be an obstacle when the patient gets on and off the chair.

SUMMARY OF THE INVENTION

This invention has for its object a solution to the above problem. The object of the invention is achieved by a unique structure in which a unit table is constructed in such a manner that the table is vertically movable and rotates relative to a horizontal plane in interlocking relation with tilting of the backrest wherein the table is remains in a horizontal position.

A description will now be given of embodiments of the present invention shown by way of example with reference to the accompanying drawings.

DETAILED DESCRIPTION OF THE INVENTION

A dental treatment chair A of the present invention includes a seat a, a backrest b tiltably secured to the seat a, and a drive means c for tilting the backrest b.

Figure 1:
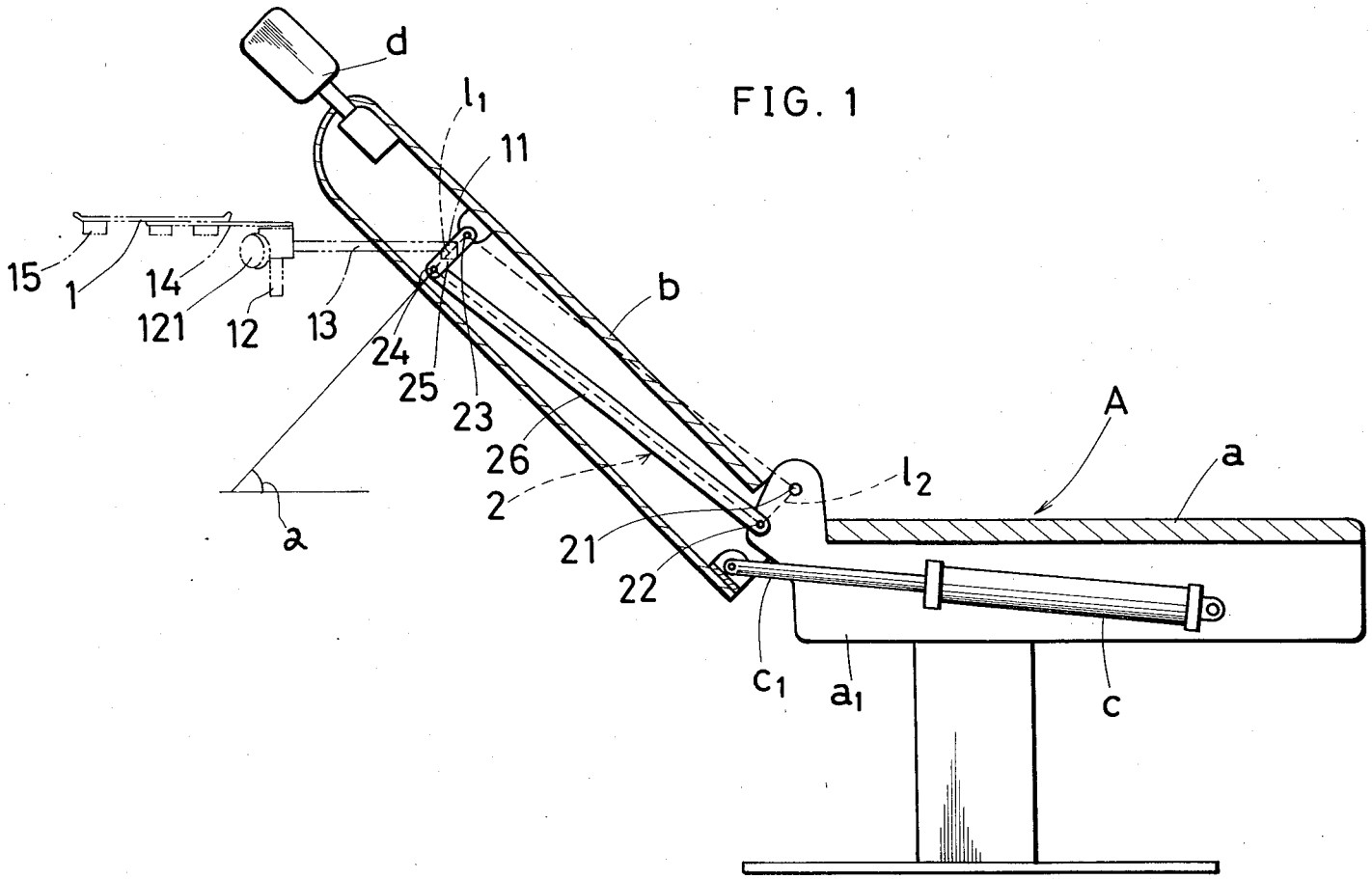
FIG. 1 is a longitudinal sectional view of a preferred embodiment of the invention.

The chair A includes a unit table 1. In the upper inside of the unit table 1 is a link 25 which is rotatable with respect to the backrest b by a pin 23 so as to keep constant the angle of incidence $\alpha$ to the axis of the link 25 constant even when the backrest tilts so as to journal a horizontal rotary arm 13 in the link 25 through a longitudinal shaft 11 and to hold at the end of the arm 13 the table 1 rotatable in a horizontal plane around a support 12. Thus, even when the backrest b tilts, the table 1 is held horizontal so that an operator can take an adequate position to access various dental tools on the table and to take a posi-tion opposite to the table. In FIG. 1, the lower end portion of the backrest b is journalled at the rear end of a frame member $a_1$ of the seat a by a transverse shaft 21.

One end of a link 26 is pivotally connected by a pin 24 to the swing end of the link 25, and the other end of the link 26 is pivotally connected to the rear end of the frame member $a_1$ of the seat a by a pin 22.

A segment $l_1$ between the pins 23 and 24 and the same length as segment $l_2$ between the transverse shaft 21 and the pin 22, and these segments $l_1$ and $l_2$ are designed to be parallel. A substantially parallel linkage 2 is thus composed of links 25 and 26, frame member $a_1$ and bracket b.

Figure 2:
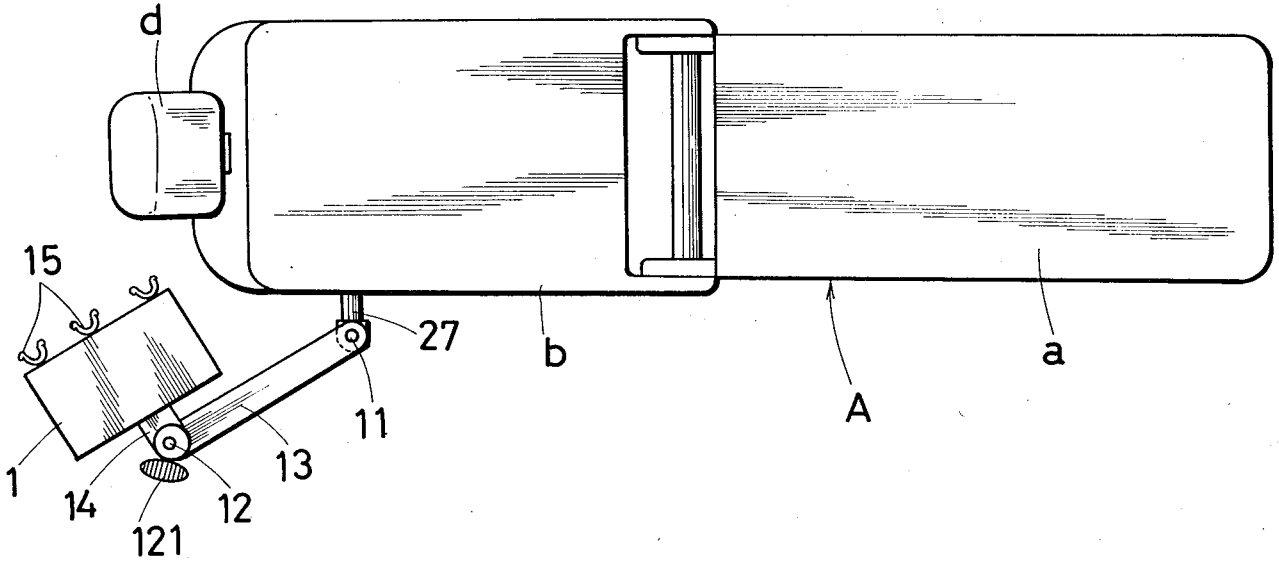
FIG. 2 is a plan view of the emodiment of FIG. 1.

In FIG. 2, a horizontal arm 27 projecting from the side of the backrest b is fixed to the link 26 arranged upwardly in the parallel linkage 2. A rotary arm 13 rotatable in a horizontal plane is journalled through a horizontal shaft 11 at the end of the arm 27. Another horizontal rotary arm 14 carrying a horizontal unit table 1 thereon is rotatably journalled at the end of the rotary arm 13 through a support 12.

Furthermore, as seen in FIG. 1, the backrest b is supported by the end of a rod $c_1$ of a hydraulic cylinder c (a drive means for tilting a backrest). The cylinder c is mounted on the side of the seat a in such a manner that the backrest b tilts around the traverse shaft 21as the cylinder rod $c_1$ moves in and out of the cylinder c.

Thus, the backrest b is able to tilt relative to the seat a by the actuation of the drive means c and by the action of the parallel linkage 2. The angle of incidence $\alpha$ of the link 25 is kept constant, and the unit table 1 held horizontally by the link 25 is kept constant, and the unit table 1 held horizontally by the link 25 is able to move up and down while being kept in a horizontal state.

The relation of the vertical position of this unit table 1 and a headrest d is determined by the position of the upper link 25 of the parallel linkage 2 and the angle of inclination of the backrest b. However, as long as the other members arranged inside the backrest b are not hindered, it is desirable in holding the unit table 1 to place the link 25 at the highest possible position so that the table 1 is positioned as near the headrest d as possible when the backrest b is in a raised position. The unit table 1 is even on the upper surface so that the dental treatment tools and medicines (not shown) can be put thereon. The unit table 1 is also provided on its side with hangers 15 for various kinds of suspendable instruments (not shown).

In the dental chair A described above, even if the backrest b is suitably moved from a horizontal position to a raised position or from a raised position to a horizontal position, the unit table 1 held by the horizontal arm 27 and horizontal rotary arm 13, which are fixed to the link 25, is always kept horizontal, since the angle of incidence $\alpha$ of the link 25 is kept constant. Thus, the unit table 1 is automatically moved up when the backrest b is moved toward the raised position, and is also automatically moved down when the backrest b is moved toward the horizontal position, so that the unit table 1 is maintained on a level related to the height of the headrest d.

In addition, the unit table 1 is held rotatably relative to a horizontal plane by a longitudinal shaft 11 and a support shaft. As a result, when a patient is treated in a horizontal position by tilting down the backrest b and keeping the patient in a horizontal posture, an operator can readily place the unit table 1 within his reach or take a position opposite to the unit table 1 by rotating the rotary arm 13 or by swinging the horizontal arm 14.

The same results are obtained even when the patient is treated in an upright position by raising the backrest b and keeping him in a sitting posture on the seat a and further, and even when the operator's position relative to the patient changes from a 12 o'clock position (position in which the opera-tor treats the patient behind the head of the latter) to a 9 o'clock position (position in which the operator treats the patient on the right side of the latter's head) or from a 9 o'clock to a 12 o'clock position.

Furthermore, even if the operator changes his operating position and posture in response to the upright or recumbent position of the patient, depending upon the kind of treatment he undergoes, the unit table 1 is always held on a level relative to the height of the mouth of a patient and is readily placed in a regular position and in position opposite to the operator. According, the operator is allowed to easily access treatment tools on the table simply by reaching his hand without bending his knees or moving himself, when he needs tools and medicines from the table or the dental instruments suspended from hangers 15. Thus, the operator can raise treatment efficiency of the and greatly relieve fatigue.

In addition, since the table includes no hanger arm that extends above the patient as seen in conventional overarm type unit tables, the table of this invention provides an additional advantage in that comfortable treatment can be rendered without the patient sensing discomfort.

Incidentally, a handle 121 can be provided at a pivotal point of a support shaft 12 of the rotary arm 13 and horizontal rotary arm 14. This handle is used when minute adjustment of the vertical position of the unit table 1 is made.

Figure 3:
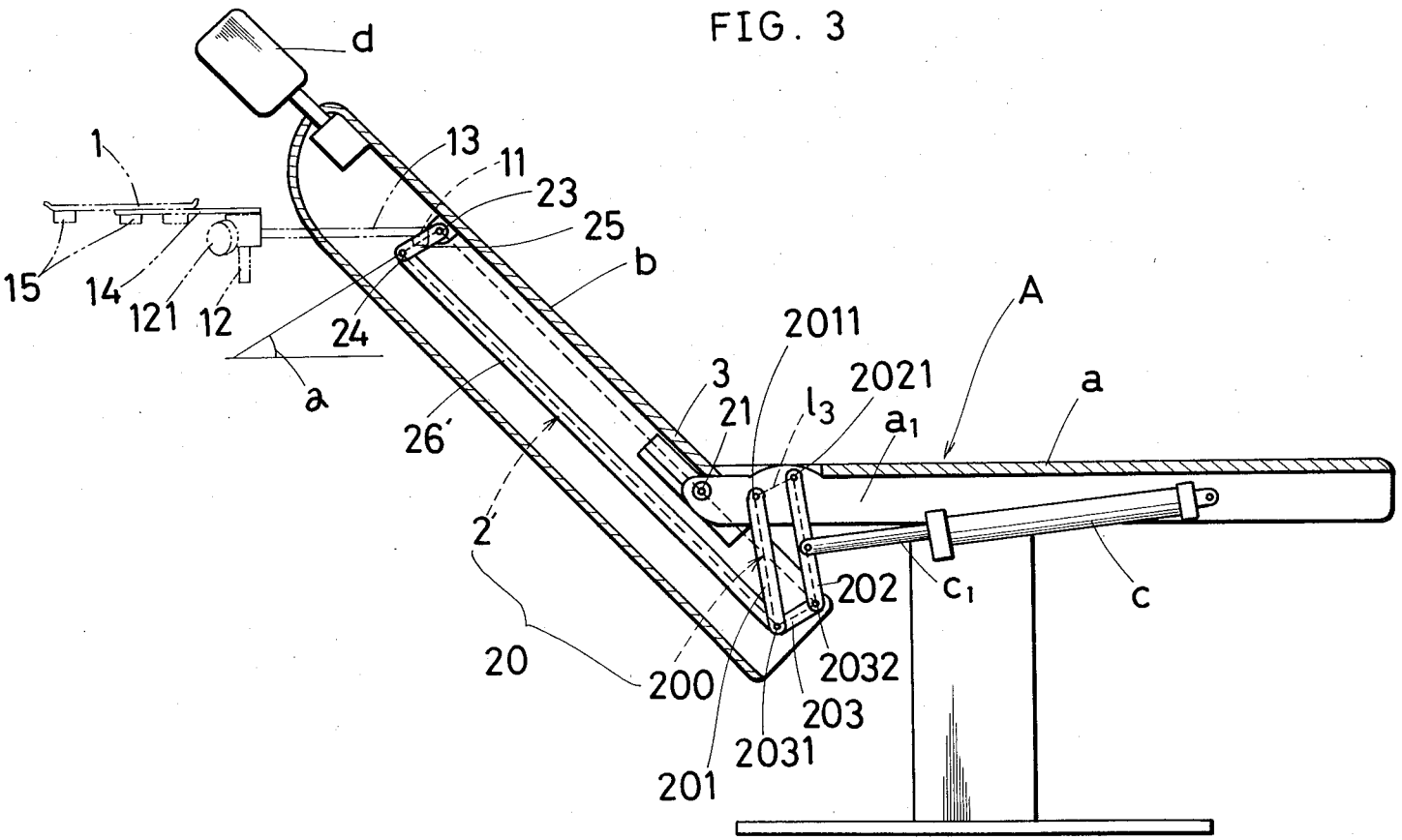
FIGS. 3 and 4 are longitudinal sectional views of other embodiments of the invention, respectively.

FIG. 3 shows another embodiment of the invention in its best mode.

Two links 201 and 202 of equal length are pivotally supported by pins 2011 and 2021, respectively. A link 203 equal in length to a segment $l_3$ between the pin 2011 and 2021 is pivotally connected by pins 2031 and 2032 to the lower ends of the link 201 and 202 to form a parallel linkage 200 under the seat a by the links 202 and 203 and a frame member $a_1$. One end of the link 26' is pivotally connected to the swing end of the link 25 by a pin 24 and the other end of the link 26' is pivotally connected to the end of the link 201 and to the end of the link 203 through the pin 2031 to form a substantially parallel linkage 2' with the links 25, 26', 203 and the backrest b inside the backrest b. The two parallel linkages 2' and 200 are joined by the link 203 to provide a dobule parallel linkage 20.

The backrest b includes a groove 3 formed on its side. A transverse shaft 21 fixed to the rear end of the frame member $a_1$ of the seat a is slidably fitted in the groove 3 so as to permit the backrest b to tilt relative to the seat a by the actuation of a drive means c and by the action of the double linkage 20 and under the cooperation control of the sliding of the transverse shaft 21 along the groove 3 and to vertically move the unit table 1 in a state kept horizontal.

A hydraulic cylinder c (a drive means for tilting the backrest) is mounted on the underside of the seat a and the end of a rod $c_1$ of the cylinder c is pivotally connected to the link 202, constituting the parallel linkage 200. When the cylinder rode $c_1$ moves, the double link 20 tilts the seat b in response to the slide of the groove 3 relative to the transverse shaft 21.

Since the link 25 holding the unit table 1 is not only parallel to the segment $l_3$ but is also fixed to the seat $a_1$, the angle of incidence $\alpha$ of the link 25 is alway kept constant even when the backrest b is tilted.

Accordingly, as described, the unit table 1 held horizontally through the horizontal rotary arm 13, horizontal rotary arm 14, longitudinal shaft 11, and support shaft 12 is allowed to move up and down and also to rotate freely in a horizontal plane in the state kept always horizontal, even when the backrest b tilts.

In the first embodiment, since the backrest b is tilted around the transverse shaft 21, it is desirable to form the center of tilt (transverse shaft 21) on the seat in order to prevent the back of the patient on the backrest b nonresponsive to the tilting to the backrest b from slipping with respect to the backrest b. Accordingly, it sometimes happens that the use of the transverse shaft 21 projecting over the seat a as an armrest can be an obstacle when a patient is getting on and off the seat a.

However, the second embodiment is constructed in such a manner that the rear end of the seat a is, in its appearance, slid along the groove 3 by the hydraulic cylinder c with the action of the two parallel linkages 2' and 200, namely a double parallel link 20, and that the seat itself has no center of tilt and the lower end of the backrest b rises as if it comes up from below the seat a and tilts down as if it sinks below the seat a. Consequently, slippage between the back of the patient and the backrest b is compensated by this manner of tilting, and there is nothing projecting above the seat a. Thus, the second embodiment is superior to the first embodiment in function as a treatment chair.

Incidentally, it is also possible to form the groove 3 as an arcuate groove having a center of curvature on the seat side, making it easy to tilt the backrest b to correspond to the movement of the back region of the patient.

Figure 4:
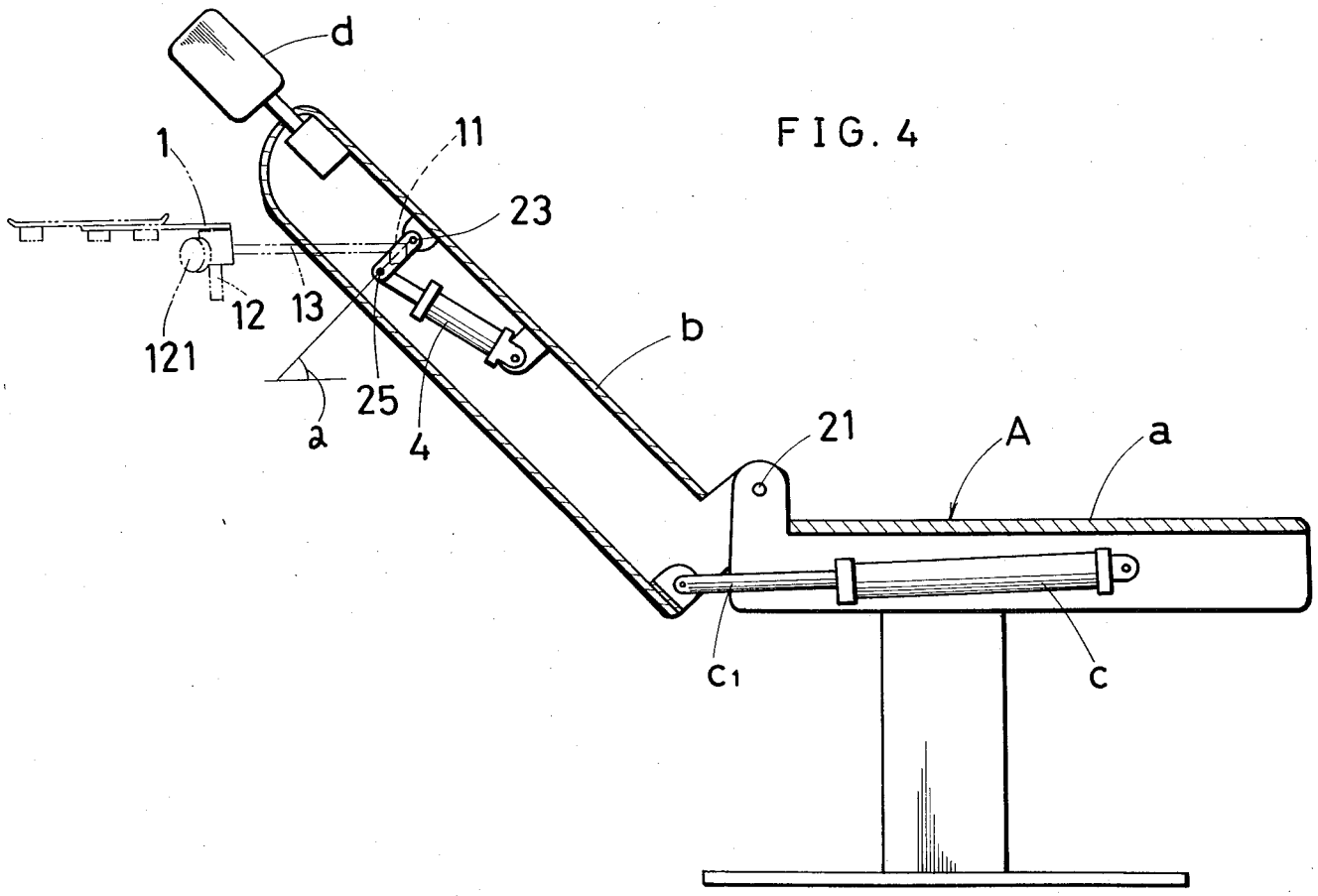

FIG. 4 shows still another embodiment of the invention, wherein the parallel linkage 2 in the first embodiment is not employed. A different type of drive means 4, a hydraulic cylinder, connected to the link 25 is mounted on the underside of the backrest b. This drive means 4 makes an angle of incidence of the link 25 constant with reference to the drive means c which tilts the backrest b. The cylinder 4 is designed to keep the angle of incidence $\alpha$ always constant so that the cylinder 4 moves in interlocking relation with the hydraulic cylinder c for tilting the backrest b. As the cylinder rod $c_1$ moves in and out of cylinder. Thus, the unit table 1 held, horizontally by the link 25 through the horizontal rotary arm 13, longitudinal shaft 11 and support shaft 12, is moved up and down and rotated freely in a horizontal plane in a state kept horizontal even when the backrest b is tilted, and accordingly the table functions in the same manner as the tables desribed in the other embodiments illustrated above.

Incidentally, in the embodiments described above, the parallel linkage 2 and 2', or the hydraulic cylinder 4, is incorporated into the backrest b. It is also possible to arrange these elements on the side of the backrest b to make them function in a like manner. Also, the drive means c for tilting the backrest is shown in the embodiments as a hydraulic cylinder, but it should be understood that other generally know drive means such as a combination of a motor and a shaft and air cylinder may also be used.

As described above, in the dental chair of the invention, even if an operator changes his treatment position or posture according to the tilting of the backrest, the unit table is not only moved automatically to the height of the patient's mouth in a state kept horizontal, but is readily brought into a position convenient to the operator during treatment activities. As a result, the operator need not bend his knees nor move himself to meet the mode of treatment caused by the tilted backrest, but rather can easily access tools, medicines and various types of treatment instruments on the table.

Thus, the operator can smoothly conduct treatment and is also relieved of fatigue. On the other hand, the patient is allowed to undergo comfortable treatment without a sense of discomfort. The dental chair according to the present has many advantages, as described above, to suit highly practical and efficient use.

I claim:

1. A dental treatment chair including a seat, a backrest tiltably secured to the seat and a first drive means for tilting the backrest, said chair including a unit table having therein on the inside top thereof a first link rotatable with respect to the backrest in a vertical plane and journalled in the backrest by a first pin, said first link being kept always constant in the angle of incidence to the axis of the first link even when the backrest tilts so as to journal a horizontal rotary arm in the first link through a longitudinal shaft and to hold at the end of the arm the table rotatable in a horizontal plane around a support shaft, whereby even when the backrest tilts, the table is arranged to be held horizontally such that an operator is enabled to take a position convenient for making access to various dental tools on the table and to take a position opposite the table, a lower end of said backrest is journalled in the lower end of a frame member of the seat through a transverse shaft, while one end of a second link is pivotally connected to the swing end of the first link through a second pin and the other end of the second link is pivotally supported through a third pin by the rear the rear end of the frame member of the seat, and a first segment between the first and second pins and a second segment between the transverse shaft and the third pin are made equal in length and horizontal so as to compose a substantially parallel first linkage of the first link, frame member and backrest in the manner that the backrest is tilted with respect to the seat by cooperation between the actuation of a drive means for tilting the backrest and the action of the parallel first linkage to move the unit table up and down in the state of the table being kept horizontal, third and fourth links of equal length with each other are pivotally supported by fourth and fifth pins, respectively, a fifth link equal in length to a third segment between the fourth and fifth pins is spanned between and pivotally connected to the lower ends of the third and fourth links through sixth and seventh pins to compose a parallel second linkage of the third and fourth links and a fifth link and a frame member on the underside of the seat and wherein one end of the seventh link is pivotally connected to swing end of the first link to a second pin and the other end of the seventh link is pivotally connected to the lower end of the third link and to one end of the fifth link through the sixth pin so as to compose a substantially parallel third linkage of the first, seventh and fifth links and the backrest inside the backrest in such a manner that the third and second linkages which are parallel, are joined by the fifth link to form a double parallel linkage and also where the backrest has a groove formed in the side thereof such that the transverse shaft fixed to the rear end of the frame member of the seat is slidably fitted into the groove to permit tilting of the backrest with respect to the seat and to permit vertical movement of the table when the table is kept horizontal under the cooperative control of the actuation of the drive means for tilting the backrest of the action of the double parallel linkage, and of the tilting of the transverse shaft with respect to the groove.

2. A dental treatment chair including a seat, a backrest tiltably secured to the seat and a first drive means for tilting the backrest, said chair including a unit table having therein on the inside top thereof a first link rotatable with respect to the backrest in a vertical plane and journalled in the backrest by a first pin, said first link being kept always constant in the angle of incidence to the axis of the first link even when the backrest tilts so as to journal a horizontal rotary arm in the first link through a longitudinal shaft and to hold at the end of the arm the table rotatable in a horizontal plane around a support shaft, whereby even when the backrest tilts, the table is arranged to be held horizontally such that an operator is enabled to take a position convenient for making access to various dental tools on the table and to take a position opposite the table, and a second drive means connected to the first link is arranged inside the seat, said second drive means being adjusted such that it is coordinated with the first drive means for tilting the backrest to make the angle of incidence of the first link constant.

3. A dental treatment chair according to claim 1 or 2 wherein said table is provided hangers adapted to suspend various dental tools therefrom.

* * * * *